US009932189B2

(12) United States Patent
Nakamura

(10) Patent No.: US 9,932,189 B2
(45) Date of Patent: Apr. 3, 2018

(54) IMAGE FORMING SYSTEM WITH SELECTIVE SKEW CORRECTION OF CONTINUOUS SHEETS, IMAGE FORMING APPARATUS WITH SELECTIVE SKEW CORRECTION OF CONTINUOUS SHEETS, AND SKEW CORRECTION METHOD

(71) Applicant: Konica Minolta, Inc., Chiyoda-ku, Tokyo (JP)

(72) Inventor: Atsushi Nakamura, Adachi-ku, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 34 days.

(21) Appl. No.: 15/045,755

(22) Filed: Feb. 17, 2016

(65) Prior Publication Data

US 2016/0236889 A1 Aug. 18, 2016

(30) Foreign Application Priority Data

Feb. 18, 2015 (JP) ..... 2015-029670

(51) Int. Cl.
*G03G 15/00* (2006.01)
*B65H 23/038* (2006.01)

(52) U.S. Cl.
CPC ..... *B65H 23/038* (2013.01); *G03G 15/55* (2013.01); *G03G 15/652* (2013.01); (Continued)

(58) Field of Classification Search
CPC ..... G03G 15/652; G03G 15/6526; G03G 15/6567; G03G 2215/00561; G03G 15/6517
See application file for complete search history.

(56) References Cited

U.S. PATENT DOCUMENTS

2012/0237240 A1 9/2012 Kiryu
2014/0002529 A1 1/2014 Muir et al.
2015/0023712 A1* 1/2015 Kawabata ..... G03G 15/6561 399/394

FOREIGN PATENT DOCUMENTS

JP 2007-70089 A 3/2007
JP 2007070089 A 3/2007
(Continued)

OTHER PUBLICATIONS

Office Action (Notice of Reasons for Rejection) issued on Jan. 18, 2017, by the Japanese Patent Office in Japanese Patent Application No. 2015-029670, and an English Translation of the Office Action. (7 pages).

(Continued)

*Primary Examiner* — Justin Olamit
(74) *Attorney, Agent, or Firm* — Buchanan Ingersoll & Rooney PC

(57) ABSTRACT

An image forming system includes: a sheet conveying section configured to convey a long sheet; an image forming/fixing section configured to execute an image forming/fixing operation to form and fix a toner image on the long sheet to be conveyed by the sheet conveying section; a skew detection section configured to detect a skew of the long sheet to be conveyed by the sheet conveying section; a skew correction section configured to execute a skew correction operation to correct the skew of the long sheet; and a control section configured to perform control to execute the skew correction operation when the skew has been detected in a first area where the skew correction operation does not affect the image forming/fixing operation, and perform control to execute the skew correction operation when the skew has been detected in a second area where the skew correction operation affects the image forming/fixing operation.

16 Claims, 3 Drawing Sheets

(52) U.S. Cl.
CPC ... *G03G 15/6517* (2013.01); *B65H 2301/331* (2013.01); *B65H 2404/15212* (2013.01); *B65H 2515/314* (2013.01); *B65H 2553/41* (2013.01); *B65H 2701/1315* (2013.01); *B65H 2701/1842* (2013.01); *B65H 2801/06* (2013.01); *G03G 15/6567* (2013.01); *G03G 2215/00561* (2013.01)

(56) References Cited

FOREIGN PATENT DOCUMENTS

| | | | |
|---|---|---|---|
| JP | 2012-116153 | A | 6/2012 |
| JP | 2013-178447 | A | 9/2013 |
| JP | 2013178447 | A | 9/2013 |

OTHER PUBLICATIONS

Office Action (Decision of Rejection) issued on Apr. 11, 2017, by the Japanese Patent Office in corresponding Japanese Patent Application No. 2015-029670 and an English Translation of the Office Action. (8 pages).

* cited by examiner

IMAGE FORMING SYSTEM WITH SELECTIVE SKEW CORRECTION OF CONTINUOUS SHEETS, IMAGE FORMING APPARATUS WITH SELECTIVE SKEW CORRECTION OF CONTINUOUS SHEETS, AND SKEW CORRECTION METHOD

The entire disclosure of Japanese Patent Application No. 2015-029670 filed on Feb. 18, 2015 including description, claims, drawings, and abstract are incorporated herein by reference in its entirety.

BACKGROUND OF THE INVENTION

Field of the Invention

The present invention relates to an image forming system, an image forming apparatus, and a skew correction method.

Description of the Related Art

Commonly, an image forming apparatus using an electrophotographic process technology (such as a printer, a copying machine, and a facsimile) forms an electrostatic latent image by irradiating (exposing) a charged photoconductor with (to) laser light based on image data. Then, the electrostatic latent image is visualized by supplying toner from a developing device to a photoconductor drum on which the electrostatic latent image is formed, and a toner image is formed accordingly. Thereafter, the toner image is directly or indirectly transferred to a sheet, and the toner image is formed on the sheet by heating and pressurizing with a fixing nip to fix the image.

Furthermore, an image forming system, in which a sheet feeding device which feeds a continuous sheet, such as a continuous roll sheet or a folded sheet, (hereinafter, referred to as a long sheet) and a sheet discharging device which stores the long sheet on which a toner image formed by the image forming apparatus are respectively connected with a pre-stage and a post-stage of the above image forming apparatus, has been in practical use.

JP 2012-116153 A discloses a technique for reducing waste sheets without a burden on an operator when image formation is resumed after a continuous paper is reset due to a jam or the like during both-side image formation. In the technique disclosed in JP 2012-116153 A, when a both-side print job is interrupted due to generation of a jam during execution of the image formation related to the both-side image formation job and then the printing is resumed, a second engine starts printing related to a one-side print job with respect to the reset continuous sheet, and when the number of pages related to the started one-side print job becomes the number of pages or less on a conveyance path between a first engine and the second engine, the printing related to the interrupted both-side print job is resumed.

Incidentally, in the above image forming system, a sheet jam, in which a long sheet being conveyed on a sheet conveyance path of the long sheet is jammed during an image forming operation to form a toner image on the long sheet, may occur. In this case, after the image forming operation is suspended and it is confirmed that a sheet jam occurring part, where the sheet jam occurs and the operation is suspended, is removed by a user, recovery to resume the suspended image forming operation is executed. Thus, occurrence of a sheet jam causes a problem that productivity is deteriorated during suspending the image forming operation.

In the technique disclosed in JP 2012-116153 A, a process, in which a jammed part is removed and a continuous paper is reset after the jam occurs, is required, and which causes a problem similar to the above problem.

SUMMARY OF THE INVENTION

An object of the present invention is to provide an image forming system, an image forming apparatus, and a skew correction method which can suppress deterioration of productivity when a toner image is formed on a long sheet.

To achieve the abovementioned object, according to an aspect, an image forming system reflecting one aspect of the present invention comprises: a sheet conveying section configured to convey a long sheet; an image forming/fixing section configured to execute an image forming/fixing operation to form and fix a toner image on the long sheet to be conveyed by the sheet conveying section; a skew detection section configured to detect a skew of the long sheet to be conveyed by the sheet conveying section; a skew correction section configured to execute a skew correction operation to correct the skew of the long sheet detected by the skew detection section; and a control section configured to perform control to execute the skew correction operation without suspending the image forming/fixing operation when the skew has been detected by the skew detection section in a first area where the skew correction operation does not affect the image forming/fixing operation, and perform control to execute the skew correction operation after suspending the image forming/fixing operation when the skew has been detected by the skew detection section in a second area where the skew correction operation affects the image forming/fixing operation.

To achieve the abovementioned object, according to an aspect, an image forming apparatus reflecting one aspect of the present invention comprises: a sheet conveying section configured to convey a long sheet; an image forming/fixing section configured to execute an image forming/fixing operation to form and fix a toner image on the long sheet to be conveyed by the sheet conveying section; a skew detection section configured to detect a skew of the long sheet to be conveyed by the sheet conveying section; a skew correction section configured to execute a skew correction operation to correct the skew of the long sheet detected by the skew detection section; and a control section configured to perform control to execute the skew correction operation without suspending the image forming/fixing operation when the skew has been detected by the skew detection section in a first area where the skew correction operation does not affect the image forming/fixing operation, and perform control to execute the skew correction operation after suspending the image forming/fixing operation when the skew has been detected by the skew detection section in a second area where the skew correction operation affects the image forming/fixing operation.

To achieve the abovementioned object, according to an aspect, a skew correction method reflecting one aspect of the present invention comprises: detecting a skew of a long sheet to be conveyed during an image forming/fixing operation to form and fix a toner image on the long sheet; and executing a skew correction operation to correct the detected skew of the long sheet during the operation, wherein the skew correction operation is executed without suspending the image forming/fixing operation when the skew has been detected in a first area where the skew correction operation does not affect the image forming/fixing operation, and the skew correction operation is executed after suspending the image forming/fixing operation when the skew has been detected in a second area where the skew correction operation affects the image forming/fixing operation.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
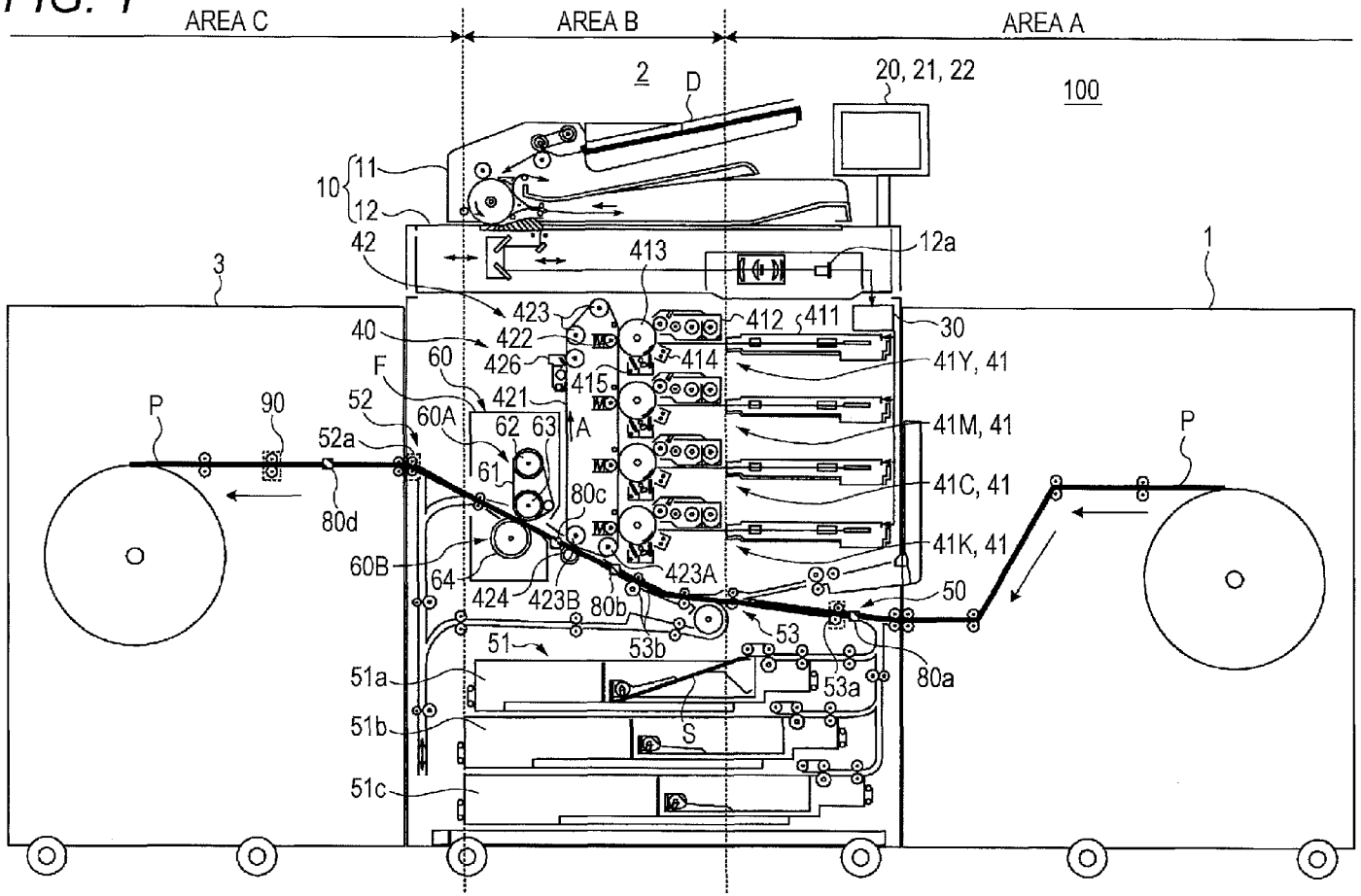
FIG. 1 is a diagram schematically illustrating a configuration of an entire image forming system in the present embodiment.
Figure 2:
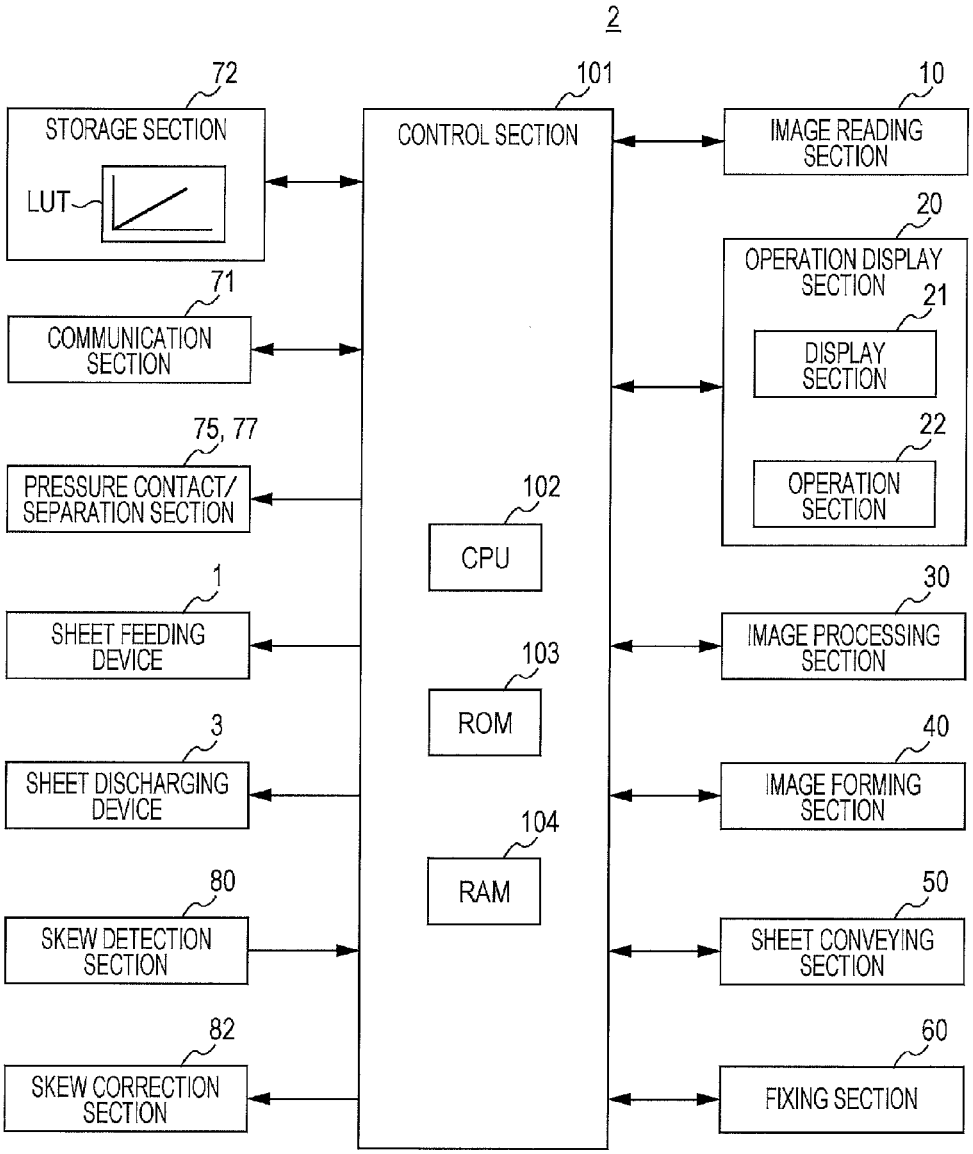
FIG. 2 is a block diagram illustrating a main part of a control system of the image forming apparatus in the present embodiment.

Hereinafter, an embodiment of the present invention will be described with reference to the drawings. However, the scope of the invention is not limited to the illustrated examples. FIG. 1 is a diagram schematically illustrating a configuration of an entire image forming system 100 according to the present embodiment. FIG. 2 illustrates a main part of a control system of an image forming apparatus 2 included in the image forming system 100 according to the present embodiment. The image forming system 100 uses, as a recording medium, a long sheet P indicated by a thick line in FIG. 1 or a sheet (also referred to as a cut sheet) S cut into a predetermined sheet size, and forms a toner image on the long sheet P or the sheet S. Here, the long sheet P is a sheet having a length longer than, for example, the main body width of the image forming apparatus 2 in the conveyance direction thereof.

As illustrated in FIG. 1, the image forming system 100 is constituted by connecting a sheet feeding device 1, a image forming apparatus 2, and a sheet discharging device 3 along the conveyance direction (hereinafter, referred to as a sheet conveyance direction) of the long sheet P from the upstream side. The sheet feeding device 1 and the sheet discharging device 3 are used when a toner image is formed on the long sheet P.

The sheet feeding device 1 feeds the long sheet P to the image forming apparatus 2. As illustrated in FIG. 1, the roll-shaped long sheet P is wound around a support shaft and rotatably held in the housing of the sheet feeding device 1. The sheet feeding device 1 conveys the long sheet P wound around the support shaft to the image forming apparatus 2 via pairs of conveyance rollers (for example, a pair of delivering rollers, or a pair of sheet feeding rollers) at a certain speed. A sheet feeding operation of the sheet feeding device 1 is controlled by a control section 101 included in the image forming apparatus 2.

Note that, in the sheet feeding device 1, the long sheet P is not necessarily held in a roll shape, and a plurality of long sheets P having a predetermined size (for example, 210 [mm]×1200 [mm]) may be held.

The image forming apparatus 2 is an intermediate transfer type color image forming apparatus using an electrophotographic process technology. In other words, the image forming apparatus 2 primary-transfers, to an intermediate transfer belt 421, toner images of yellow (Y), magenta (M), cyan (C), and black (K) formed on a photoconductor drum 413, and superimposes the toner images of the four colors on the intermediate transfer belt 421. Then, the image forming apparatus 2 secondary-transfers the superimposed image to the long sheet P fed from the sheet feeding device 1 or the sheet S fed from sheet feed tray units 51*a* to 51*c*, and forms a toner image accordingly.

Furthermore, the image forming apparatus 2 employs a tandem system in which the photoconductor drums 413 each corresponding to the four colors of YMCK are disposed in series in the travelling direction of the intermediate transfer belt 421 and the toner images of the four colors are sequentially transferred to the intermediate transfer belt 421 in one procedure.

As illustrated in FIG. 2, the image forming apparatus 2 includes an image reading section 10, an operation display section 20, an image processing section 30, an image forming section 40, a sheet conveying section 50, a fixing section 60, pressure contact/separation sections 75 and 77, a skew detection section 80, a skew correction section 82, and a control section 101. Note that, the image forming section 40 and the fixing section 60 correspond to an image forming/fixing section of the present invention.

The control section 101 includes a central processing unit (CPU) 102, a read only memory (ROM) 103, and a random access memory (RAM) 104. The CPU 102 reads a program according to the processing contents from the ROM 103, develops the program in the RAM 104, and centrally controls operations of the blocks of the image forming apparatus 2 in cooperation with the developed program. At this time, various kinds of data stored in a storage section 72 is referred. The storage section 72 is constituted of, for example, a non-volatile semiconductor memory (called as a flash memory) or a hard disk drive.

The control section 101 transmits and receives various kinds of data to and from an external apparatus (for example, a personal computer) connected to a communication network, such as a local area network (LAN) or a wide area network (WAN), through a communication section 71. The control section 101 receives, for example, image data (input image data) transmitted from the external apparatus and forms an image on the long sheet P or the sheet S based on the data. The communication section 71 is constituted of, for example, a communication control card, such as a LAN card.

The image reading section 10 includes an auto document feeder (ADF) 11 and a document image scanner (scanner) 12.

The auto document feeder 11 conveys a document D placed on a document tray with a conveyance mechanism and feeds the document D to the document image scanner 12. With the auto document feeder 11, it is possible to successively read the images (including the images on both sides) of a large number of documents D placed on the document tray at once.

The document image scanner 12 optically scans a document conveyed on a contact glass from the auto document feeder 11 or a document placed on the contact glass, images light reflected from the document on a light-receiving surface of a charge coupled device (CCD) sensor 12*a*, and reads the document image. The image reading section 10 generates input image data based on the reading result by the document image scanner 12. The image processing section 30 performs a predetermined image process to the input image data.

The operation display section 20 is constituted of, for example, a liquid crystal display (LCD) with a touch panel and functions as a display section 21 and an operation section 22. The display section 21 displays various operation screens, image statuses, operation conditions of each function, and the like according to a display control signal input from the control section 101. The operation section 22 includes various operation keys, such as a numeric keypad and a start key, receives various input operations by a user, and outputs an operation signal to the control section 101.

The image processing section 30 includes a circuit or the like which performs a digital image process to the input image data according to an initial setting or a user setting. For example, the image processing section 30 performs, based on tone correction data (a tone correction table), tone correction under the control of the control section 101. Furthermore, the image processing section 30 performs, to the input image data, various correction processes in addition to the tone correction, such as color correction and shading correction, and a compression process. The image forming section 40 is controlled based on the image data subjected to these processes.

The image forming section 40 includes image forming units 41Y, 41M, 41C, and 41K, and an intermediate transfer unit 42. The image forming units 41Y, 41M, 41C, and 41K forms, based on the input image data, images of colored toners of a Y component, an M component, a C component, and a K component.

The image forming units 41Y, 41M, 41C, and 41K for the Y component, the M component, the C component, and the K component have a similar configuration. For ease of illustration and description, common component elements are denoted by the same reference signs. When the component elements need to be distinguished from one another, Y, M, C, or Kis added to the reference signs. In FIG. 1, reference signs are assigned only to the component elements of the image forming unit 41Y for the Y component, and reference signs for the component elements of the other image forming units 41M, 41C, and 41K are omitted.

The image forming unit 41 includes an exposing device 411, a developing device 412, a photoconductor drum 413, a charging device 414, and a drum cleaning device 415.

The photoconductor drum 413 is a negative-charge-type organic photoconductor (OPC) formed by sequentially laminating an under coat layer (UCL), a charge generation layer (CGL), and a charge transport layer (CTL) on the circumferential surface of an aluminum conductive cylindrical body (aluminum-elementary tube) having, for example, a drum diameter of 80 [mm]. The charge generation layer is formed of an organic semiconductor in which a charge generating material (for example, phthalocyanine pigment) is dispersed in a resin binder (for example, polycarbonate), and generates a pair of positive charge and negative charge by being exposed to light by an exposure device 411. The charge transport layer is formed of a layer in which a hole transport material (electron-donating nitrogen compound) is dispersed in a resin binder (for example, polycarbonate resin), and transports the positive charge generated in the charge generation layer to the surface of the charge transport layer.

The control section 101 rotates the photoconductor drum 413 at a certain peripheral speed by controlling a drive current supplied to a drive motor (not illustrated) which rotates the photoconductor drum 413.

The charging device 414 evenly negatively charges the surface of the photoconductor drum 413 having photoconductivity. The exposing device 411 is constituted of, for example, a semiconductor laser, and irradiates the photoconductor drum 413 with the laser light corresponding to the image of each color component. The positive charge is generated in the charge generation layer of the photoconductor drum 413 and transported to the surface of the charge transport layer, and surface charge (negative charge) of the photoconductor drum 413 is neutralized accordingly. The electrostatic latent image of each color component is formed on the surface of the photoconductor drum 413 according to the potential difference between the neutralized part and the other part.

The developing device 412 is a two-component developing type developing device, visualizes the electrostatic latent image by attaching the toner of each color component to the surface of the photoconductor drum 413, and forms the toner image accordingly.

The drum cleaning device 415 has a drum cleaning blade which slidably contacts with the surface of photoconductor drum 413, and removes transfer residual toner remaining on the surface of photoconductor drum 413 after the primary transfer.

The intermediate transfer unit 42 includes an intermediate transfer belt 421, a primary transfer roller 422, a plurality of support rollers 423, a secondary transfer roller 424, and a belt cleaning device 426.

The intermediate transfer belt 421 is constituted of an endless belt, and is stretched around the support rollers 423 in a loop shape. At least one of the support rollers 423 is constituted of a driving roller, and the others are each constituted of a following roller. For example, it is preferable that a roller 423A disposed at the downstream side of the primary transfer roller 422 for the K component in the belt travelling direction is the driving roller. Thus, the travelling speed of the belt in the primary transfer section is easily maintained. The driving roller 423A is rotated, and the intermediate transfer belt 421 travels in the arrow A direction at a certain speed accordingly.

The intermediate transfer belt 421 is a belt having conductivity and elasticity, and has a high resistance layer, in which the volume resistivity is 8 to 11 [log Ω·cm], on the surface. The intermediate transfer belt 421 is rotationally driven according to a control signal from the control section 101. Note that, as long as the intermediate transfer belt 421 has conductivity and elasticity, the material, thickness and hardness thereof are not limited.

The primary transfer roller 422 is disposed at the inner peripheral surface side of the intermediate transfer belt 421 opposing to the photoconductor drum 413 for each color component. The primary transfer roller 422 is brought into pressure contact with the photoconductor drum 413 sandwiching the intermediate transfer belt 421 therebetween, and a primary transfer nip to transfer the toner image from the photoconductor drum 413 to the intermediate transfer belt 421 is formed accordingly.

The secondary transfer roller 424 is disposed at the outer peripheral surface side of the intermediate transfer belt 421 opposing to a backup roller 423B disposed at the downstream side of the driving roller 423A in the belt travelling direction. The secondary transfer roller 424 is brought into pressure contact with the backup roller 423B sandwiching the intermediate transfer belt 421 therebetween, and a secondary transfer nip to transfer the toner image from the intermediate transfer belt 421 to the long sheet P or the sheet S is formed accordingly. The secondary transfer roller 424 is brought into pressure contact with the intermediate transfer belt 421 by the pressure contact/separation section 75 (see FIG. 2) at a predetermined transfer pressure. The pressure contact/separation section 75 has a known configuration, and brings the secondary transfer roller 424 into pressure contact with the intermediate transfer belt 421 or separates the secondary transfer roller 424 from the intermediate transfer belt 421. The drive control of the pressure contact/separation section 75 is performed by the control section 101.

When the intermediate transfer belt 421 passes through the primary transfer nip, the toner images on the photoconductor drum 413 are sequentially primary-transferred to the intermediate transfer belt 421. Specifically, a primary transfer voltage is applied to the primary transfer roller 422, and charge having a reversed polarity to the toner is applied to the rear surface side of the intermediate transfer belt 421 (the side in contact with the primary transfer roller 422). The toner image is electrostatically transferred to the intermediate transfer belt 421 accordingly.

Thereafter, when the long sheet P or the sheet S passes through the secondary transfer nip, the toner image on the intermediate transfer belt 421 is secondary-transferred to the long sheet P or the sheet S. Specifically, a secondary transfer voltage is applied to the secondary transfer roller 424, and charge having a reversed polarity to the toner is applied to the rear surface side of the long sheet P or the sheet S (the side in contact with the secondary transfer roller 424). The toner image is electrostatically transferred to the long sheet P or the sheet S accordingly. The long sheet P or the sheet S, to which the toner image is transferred, is to be conveyed to the fixing section 60.

The belt cleaning device 426 removes transfer residual toner remaining on the surface of the intermediate transfer belt 421 after the secondary transfer. Note that, a configuration in which a secondary transfer belt is stretched around the support rollers including the secondary transfer roller in a loop shape (called as a belt-type secondary transfer unit) may be applied instead of the secondary transfer roller 424.

The fixing section 60 includes an upper side fixing section 60A and a lower side fixing section 60B. The upper side fixing section 60A has a fixing surface side member disposed on the fixing surface (the face on which the toner image is formed) side of the long sheet P or the sheet S. The lower side fixing section 60B has a rear surface side support member disposed on the rear surface (the surface opposite to the fixing surface) side of the long sheet P or the sheet S. The rear surface side support member is brought into pressure contact with the fixing surface side member, and the fixing nip, which holds and conveys the long sheet P or the sheet S, is formed.

The fixing section 60 fixes the toner image on the long sheet P or the sheet S by heating and pressurizing the conveyed long sheet P or the sheet S, to which the toner image is secondary-transferred, with the fixing nip. The fixing section 60 is disposed as a unit in a fixing device F. Furthermore, an air separation unit, which separates the long sheet P or the sheet S from the fixing surface side member or the rear surface side support member by blowing air, may be disposed in the fixing device F.

The upper side fixing section 60A has an endless fixing belt 61 which is the fixing surface side member, a heating roller 62, and a fixing roller 63 (belt heating type). The fixing belt 61 is stretched around the heating roller 62 and the fixing roller 63 at predetermined belt tension (for example, 40 [N]).

The fixing belt 61 touches the long sheet P or the sheet S, on which the toner image is formed, and heats and fixes the toner image on the long sheet P or the sheet S at a fixing temperature (for example, 160 to 200 [° C.]). Here, the fixing temperature is a temperature capable of supplying the amount of heat required to melt the toner on the long sheet P or the sheet S and varies according to a sheet type of the long sheet P or the sheet S on which an image is to be formed.

The heating roller 62 incorporates a heating source (halogen heater) and heats the fixing belt 61. The heating roller 62 is heated with the heating source, and the fixing belt 61 is heated accordingly.

The fixing roller 63 is formed by sequentially laminating an elastic layer formed of silicone rubber (for example, thickness: 10 [mm]) and a surface layer formed of fluorine resin, such as PTFE, (for example, thickness: 70 [μm]) on the outer peripheral surface of a cylindrical core metal formed of, for example, aluminum. The drive control (for example, ON/OFF of the rotation and a peripheral speed) of the fixing roller 63 is performed by the control section 101. The control section 101 rotates the fixing roller 63 in the clockwise direction. The fixing roller 63 is rotated, and the fixing belt 61 and the heating roller 62 are followingly rotated in the clockwise direction accordingly.

The lower side fixing section 60B has a pressure roller 64 which is the rear surface side support member (roller pressurizing type). The pressure roller 64 is formed by sequentially laminating an elastic layer formed of silicone rubber and a surface layer formed of a PFA tube on the outer peripheral surface of a cylindrical core metal formed of, for example, iron. The pressure roller 64 is brought into pressure contact with the fixing roller 63 by the pressure contact/separation section 77 (see FIG. 2) through the fixing belt 61 at a predetermined fixing pressure (for example, 1000 [N]). The pressure contact/separation section 77 has a known configuration, and brings the pressure roller 64 into pressure contact with the fixing belt 61 or separates the pressure roller 64 from the fixing belt 61. As described above, the fixing nip, which holds and conveys the long sheet P or the sheet S, is formed between the fixing roller 63 and the pressure roller 64 through the fixing belt 61. The drive control (for example, ON/OFF of the rotation and a peripheral speed) of the pressure roller 64 and the drive control of the pressure contact/separation Section 77 are performed by the control section 101. The control section 101 rotates the pressure roller 64 in the counterclockwise direction.

The sheet conveying section 50 includes a sheet feeding section 51, a sheet discharging section 52, and a conveyance path section 53. In three sheet feed tray units 51*a* to 51*c* constituting the sheet feeding section 51, the sheet S sorted based on a basis weight, a size, or the like (a standard sheet or a special sheet) is stored for each predetermined type. The conveyance path section 53 has pairs of conveyance rollers including a pair of resist rollers 53*b*. A resist roller section, in which the pair of resist rollers 53*b* are arranged, corrects the inclination and deviation of the sheet S or the long sheet P.

The sheet S stored in the sheet feed tray units 51*a* to 51*c* is fed from the top one by one, and to be conveyed to the image forming section 40 by the conveyance path section 53. The toner images on the intermediate transfer belt 421 are collectively secondary-transferred to one surface of the sheet S in the image forming section 40, and subjected to a fixing process in the fixing section 60. Furthermore, the long sheet P fed from the sheet feeding device 1 to the image forming apparatus 2 is to be conveyed to the image forming section 40 by the conveyance path section 53. Then, the toner images on the intermediate transfer belt 421 are collectively secondary-transferred to one side of the long sheet P in the image forming section 40, and subjected to the fixing process in the fixing section 60. The long sheet P or the sheet S, on which the image is formed, is to be conveyed to a sheet discharging device 3 by the sheet discharging section 52 including a pair of sheet discharge rollers 52*a*.

The sheet discharging device 3 winds and stores the long sheet P conveyed from the image forming apparatus 2. For example, the long sheet P is wound around the support shaft and held in a roll-shape in the housing of the sheet discharging device 3 as illustrated in FIG. 1. Thus, the sheet discharging device 3 winds the long sheet P conveyed from the image forming apparatus 2 around the support shaft via pairs of conveyance rollers (for example, a pair of delivering rollers and a pair of sheet discharge rollers) at a certain speed. The winding operation of the sheet discharging device 3 is controlled by the control section 101 included in the image forming apparatus 2.

The skew detection section 80 has skew detection sensors 80*a* to 80*d*, and detects a skew of the long sheet P to be conveyed by the sheet conveying section 50 during an image forming/fixing operation, in which the toner image is formed and fixed on the long sheet P, at the positions where the skew detection sensors 80*a* to 80*d* are disposed. When detecting the skew of the long sheet P, the skew detection sensors 80*a* to 80*d* output detection information indicating the result to the control section 101. The skew detection sensors 80*a* to 80*d* are each constituted of, for example, a mechanism, such as an optical sensor or a mechanical switch, and detect the skew of the long sheet P by checking whether or not both-end positions of the long sheet P in the sheet width direction are in the appropriate desired positions.

The skew correction section 82 executes a skew correction operation to correct the skew of the long sheet P detected by the skew detection section 80 under the control of the control section 101. The skew correction operation is an operation where a rotation axis of a roller (corresponding to a rotor of the present invention), which exists in the vicinity of the position where the skew of the long sheet P has been detected and is used to convey the long sheet P, is inclined in the direction orthogonal to the conveyance direction of the long sheet P called as a steering operation).

As illustrated in FIG. 1, the sheet conveyance path on which the long sheet P is to be conveyed in the image forming system 100 is divided into three areas of A, B, and C, and the skew detection section 80 detects the skew of the long sheet P in either area A, B, or C. According to the detected area, the control section 101 controls the skew correction section 82 to change the execution mode of the skew correction operation. The areas A and C (corresponding to a first area of the present invention) is positioned at the upstream side of the image forming section 40 in the sheet conveyance direction of the long sheet P, and is an area where a defective image (defective fixing), such as image roughness, is not generated if the skew correction operation is executed during the image forming/fixing operation, that is, where the skew correction operation does not affect the image forming/fixing operation. The area B (corresponding to a second area of the present invention) is positioned at the downstream side of the area A and at the upstream side of the area C in the sheet conveyance direction of the long sheet P, and an area where a defective image, such as image roughness, is generated if the skew correction operation is executed during the image forming/fixing operation, that is, where the skew correction operation affects the image forming/fixing operation.

The skew detection sensor 80*a* is disposed at the conveyance path section 53 of the image forming apparatus 2 in the area A. When the skew detection sensor 80*a* has detected the skew of the long sheet P, the control section 101 controls the image forming section 40, the fixing section 60, and the skew correction section 82 to execute the skew correction operation to correct the skew of the long sheet P without suspending the image forming/fixing operation. Specifically, the skew correction section 82 corrects the skew of the long sheet P by inclining the rotation axis of one of a pair of conveyance rollers 53*a* disposed in the vicinity of the skew detection sensor 80*a* in the direction orthogonal to the conveyance direction of the long sheet P (the vertical direction in FIG. 1).

The skew detection sensor 80*b* is disposed at the upstream side of the secondary transfer nip in the sheet conveyance direction of the long sheet P in the area B. When the skew detection sensor 80*b* has detected the skew of the long sheet P, the control section 101 controls the image forming section 40, the fixing section 60, and the skew correction section 82 to execute the skew correction operation to correct the skew of the long sheet P after suspending the image forming/fixing operation. This is because when the skew of the long sheet P has been detected in the vicinity of the image forming section 40, a defective image, such as image roughness, is generated due to the displacement of the long sheet P at the secondary transfer nip in the sheet width direction if the skew correction operation is executed without suspending the image forming/fixing operation. Specifically, the skew correction section 82 corrects the skew of the long sheet P by inclining the rotation axis of the secondary transfer roller 424 disposed in the vicinity of the skew detection sensor 80*b* and forming the secondary transfer nip in the direction orthogonal to the conveyance direction of the long sheet P (the vertical direction in FIG. 1).

The skew detection sensor 80*c* is disposed at the downstream side of the secondary transfer nip in the sheet conveyance direction of the long sheet P and at the upstream side of the fixing nip in the area B. When the skew detection sensor 80*c* has detected the skew of the long sheet P, the control section 101 controls the image forming section 40, the fixing section 60, and the skew correction section 82 to execute the skew correction operation to correct the skew of the long sheet P after suspending the image forming/fixing operation. This is because when the skew of the long sheet P has been detected in the vicinity of the fixing section 60, defective fixing, such as image roughness, is generated due to the displacement of the long sheet P at the fixing nip in the sheet width direction if the skew correction operation is executed without suspending the image forming/fixing operation. Specifically, the skew correction section 82 corrects the skew of the long sheet P by inclining the rotation axis of the pressure roller 64 disposed in the vicinity of the skew detection sensor 80*c* and forming the fixing nip in the direction orthogonal to the conveyance direction of the long sheet P (the vertical direction in FIG. 1).

The skew detection sensor 80*d* is disposed on the conveyance path of the sheet discharging device 3 in the area C. When the skew detection sensor 80*d* has detected the skew of the long sheet P, the control section 101 controls the image forming section 40, the fixing section 60, and the skew correction section 82 to execute the skew correction operation to correct the skew of the long sheet P without suspending the image forming/fixing operation. Specifically, the skew correction section 82 corrects the skew of the long sheet P by inclining the rotation axis of one of a pair of conveyance rollers 90 disposed in the vicinity of the skew detection sensor 80*d* in the direction orthogonal to the conveyance direction of the long sheet P (the vertical direction in FIG. 1).

Figure 3:
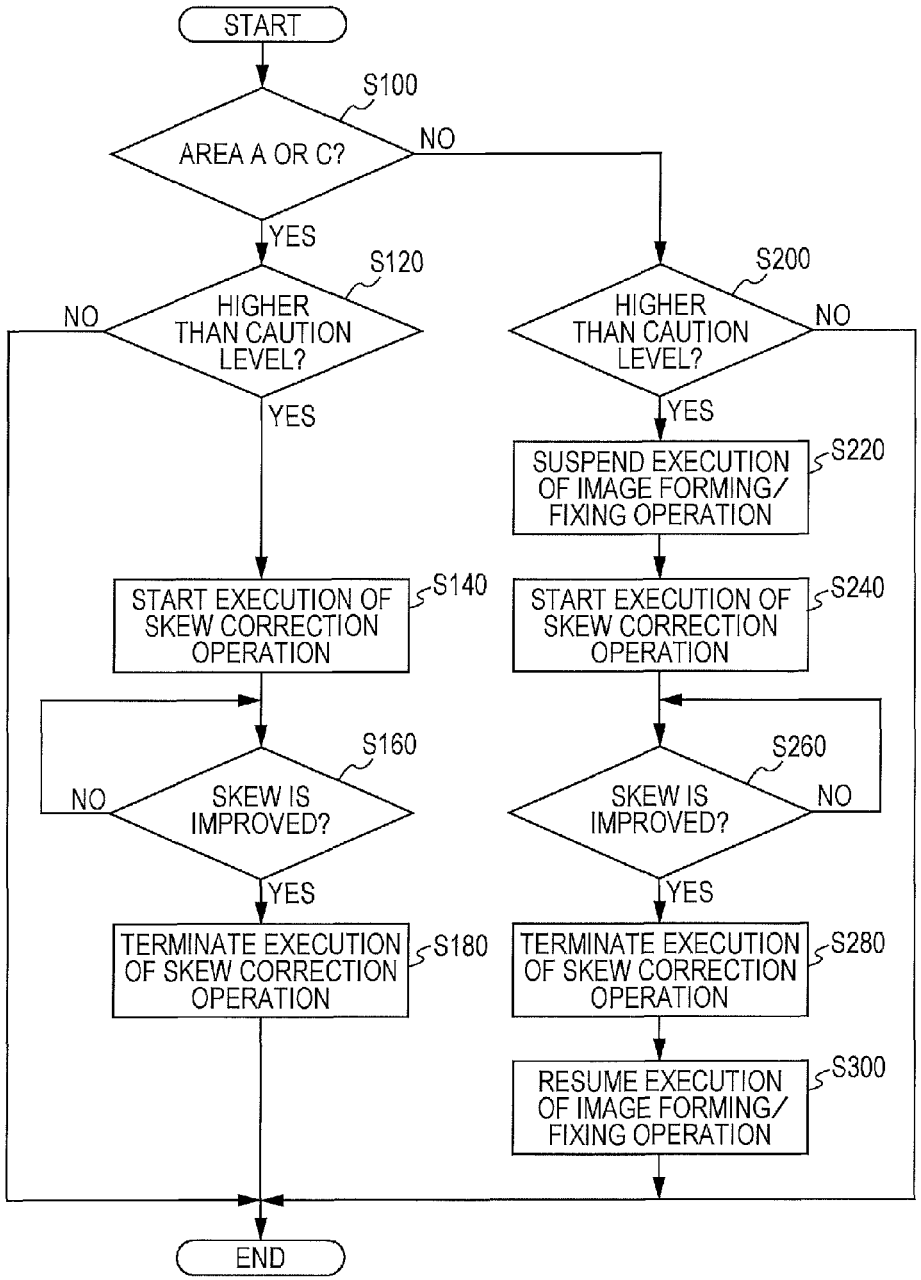
FIG. 3 is a flowchart illustrating a skew correction operation of the image forming system in the present embodiment.

Next, an example of the skew correction operation of the image forming system 100 in the present embodiment will be described with reference to the flowchart of FIG. 3. Note that, the skew correction operation illustrated in FIG. 3 is executed every time the skew detection section 80 detects the skew of the long sheet P after the control section 101 starts the execution of the image forming operation to form the toner image on the long sheet P in response to an execution instruction of a print job through a user operation to the operation section 22.

First, the control section 101 determines whether or not the skew detection section 80 detects the skew of the long sheet P in the area A or the area C (step S100). As a result of the determination, when the skew of the long sheet P has been detected in the area A or the area C (step S100, YES), the control section 101 determines whether or not the detected skew state of the long sheet P is higher than a caution level (step S120). Here, it is assumed that the skew state of the long sheet P is higher than the caution level (step S120). Here, that the skew state of the long sheet P is higher than the caution level means that the conveyance state of the long sheet P is different from the appropriate desired conveyance state of the long sheet P. For example, the cases where the long sheet P is inclined with respect to the appropriate sheet conveyance direction, where the long sheet P is shifted in the width direction of the appropriate sheet conveyance path without being inclined in the appropriate sheet conveyance direction, and the like are applied to this. As a result of the determination in step S120, when the detected skew state of the long sheet P is not higher than the caution level, that is, when it is determined that a sheet jam hardly occurs without executing the skew correction operation (step S120, NO), the image forming system 100 terminates the process in FIG. 3.

On the other hand, when the detected skew state of the long sheet P is higher than the caution level, that is, when it is determined that a sheet jam probably occurs unless the skew correction operation is executed (step S120, YES), the control section 101 controls the skew correction section 82 to start the execution of the skew correction operation to correct the skew of the long sheet P (step S140). Next, the control section 101 determines whether or not the skew of the long sheet P has been improved based on the detection result of the skew detection section 80 (step S160). Here, that the skew of the long sheet P is improved means that the conveyance state of the long sheet P completely matches the appropriate desired conveyance state of the long sheet P, and that the conveyance state of the long sheet P approaches to the appropriate desired conveyance state of the long sheet P, and includes the case where the long sheet P is not to be substantially inclined when the long sheet P is inclined with respect to the appropriate sheet conveyance direction. As a result of the determination in step S160, when the skew of the long sheet P has not been improved (step S160, NO), the process returns prior to step S160.

On the other hand, when the skew of the long sheet P has been improved (step S160, YES), the control section 101 controls the skew correction section 82 to terminate the execution of the skew correction operation (step S180). With the completion of the process in step S180, the image forming system 100 terminates the process in FIG. 3.

Returning back to the determination in step S100, when the skew of the long sheet P has not been detected in the area A or the area C, that is, when the skew of the long sheet P has been detected in the area B (step S100, NO), the control section 101 determines whether or not the detected skew state of the long sheet P is higher than the caution level (step S200). As a result of the determination, when the detected skew state of the long sheet P is not higher than the caution level, that is, when it is determined that a sheet jam hardly occurs without executing the skew correction operation (step S200, NO), the image forming system 100 terminates the process in FIG. 3.

On the other hand, when the detected skew state of the long sheet P is higher than the caution level, that is, when it is determined that a sheet jam probably occurs unless the skew correction operation is executed (step S200, YES), the control section 101 controls the image forming section 40 and the fixing section 60 to suspend the execution of the image forming/fixing operation (step S220). However, the control section 101 controls the sheet conveying section 50 to continue the conveyance operation of the long sheet P in order to execute the skew correction operation in the post-process.

Next, the control section 101 controls the skew correction section 82 to start the execution of the skew correction operation to correct the skew of the long sheet P (step S240). Next, the control section 101 determines whether or not the skew of the long sheet P has been improved based on the detection result of the skew detection section 80 (step S260). As a result of the determination, when the skew of the long sheet P has not been improved (step S260, NO), the process returns prior to step S260.

On the other hand, when the skew of the long sheet P has been improved (step S260, YES), the control section 101 controls the skew correction section 82 to terminate the execution of the skew correction operation (step S280). Finally, the control section 101 controls the image forming section 40 and the fixing section 60 to resume the execution of the image forming/fixing operation (step S300). With the completion of the process in step S300, the image forming system 100 terminates the process in FIG. 3.

Note that, in the flowchart of FIG. 3, when the skew of the long sheet P has not been improved for a certain time with the execution of the skew correction operation, or when the skew state of the long sheet P is changed for the worse and higher than a warning level, the control section 101 may control the image forming section 40 and the fixing section 60 to immediately terminate the execution of the print job. Here, that the skew state of the long sheet P is higher than the warning level means that the improvement of the skew of the long sheet P cannot be expected and a sheet jam or a sheet winkle probably occurs.

Furthermore, when the skew of the long sheet P has been detected in the area B (by the skew detection sensor 80*b*), the skew correction section 82 may correct the skew of the long sheet P by reducing the nip pressure of the secondary transfer nip or separating the secondary transfer roller 424 from the backup roller 423B instead of inclining the rotation axis of the secondary transfer roller 424. Moreover, when the skew of the long sheet P has been detected in the area B (by the skew detection sensor 80*c*), the skew correction section 82 may correct the skew of the long sheet P by reducing the nip pressure of the fixing nip or separating the pressure roller 64 from the fixing roller 63 instead of inclining the rotation axis of the pressure roller 64.

Incidentally, when the toner image is formed on the long sheet P, a certain degree of tension is needed to be constantly applied to the long sheet P in the sheet conveyance direction of the long sheet P, and the conveyance speed at the downstream side of the long sheet P is set to be faster than the conveyance speed at the upstream side. Thus, when the skew of the long sheet P has not improved with the execution of the skew correction operation in the above described manner, a skew correction operation, in which the skew of the long sheet P is corrected by, based on a skew detection sensor which has detected the skew of the long sheet P, reducing the conveyance speed at the downstream side in the sheet conveyance direction of the long sheet P and adjusting the tension applied to the long sheet P, may be executed. Especially, when the long sheet P is a thick sheet, stiffness of the sheet is strong, and it is preferable that the conveyance speed at the downstream side in the sheet conveyance direction of the long sheet P is to be reduced as compared to the case where the long sheet P is a thin sheet.

As detailedly described above, in the present embodiment, the image forming system 100 includes the sheet conveying section 50 which conveys the long sheet P, the image forming/fixing section (the image forming section 40 and the fixing section 60) which executes the image forming/fixing operation to form and fix the toner image on the long sheet P to be conveyed by the sheet conveying section 50, the skew detection section 80 which detects the skew of the long sheet P to be conveyed by the sheet conveying section 50, the skew correction section 82 which executes the skew correction operation to correct the skew of the long sheet P detected by the skew detection section 80, and the control section 101 which performs control to execute the skew correction operation without suspending the image forming/fixing operation when the skew has been detected in the area A or C where the skew correction operation does not affect the image forming/fixing operation, and performs control to execute the skew correction operation after suspending the execution of the image forming/fixing operation when the skew has been detected in the area B where the skew correction operation affects the image forming/fixing operation.

According to the present embodiment having such configuration, when the skew of the long sheet P which can lead to occurrence of a sheet jam is detected during the image forming/fixing operation to form and fix the toner image on the long sheet P, it is possible to execute the skew correction operation without suspending the image forming/fixing operation as much as possible, and to prevent the occurrence of a sheet jam. Thus, as compared to the conventional technique in which a recovery process is needed to be performed after suspending the image forming operation when a sheet jam occurs, it is possible to suppress deterioration of productivity when the toner image is formed on the long sheet P. Furthermore, by preventing the occurrence of a sheet jam, it is possible to prevent waste parts (the part where a sheet jam occurs) from generating in the long sheet P.

Moreover, in the present embodiment, when the skew correction operation is executed after suspending the execution of the image forming/fixing operation, the long sheet P is continued to be conveyed. Thus, as compared to the case where the conveyance of the long sheet P is suspended once and then resumed, it is possible to reduce a part of the sheet fed when the conveyance is suspended or a damage to the sheet at the fixing nip after suspending the conveyance, and a part of the sheet fed during a warm-up time after resuming the image forming/fixing operation, and it is possible to suppress waste parts of the long sheet P from generating accordingly.

Note that, in the above embodiment, the area C is the area where the long sheet P is to be conveyed after forming/fixing the image, and the skew correction operation may not be necessarily executed when the skew of the long sheet P has been detected in the area C. However, a conveyance shift or a sheet winkle may occur when the long sheet P conveyed from the image forming apparatus 2 is wound in the sheet discharging device 3, and it is preferable that the skew of the long sheet P is detected and the skew correction operation is executed in the area C.

In the above embodiment, although the example where a skew detection sensor is disposed in the area A has been described, two or more skew detection sensors may be disposed. Furthermore, in the area A, the skew detection sensor may be disposed in the sheet feeding device 1 instead of the image forming apparatus 2, or may be disposed both in the image forming apparatus 2 and the sheet feeding device 1. Although the example where two skew detection sensors are disposed in the area B has been described, a skew detection sensor, or three or more skew detection sensors may be disposed. Although the example where a skew detection sensor is disposed in the area C has been described, two or more skew detection sensors may be disposed.

Furthermore, any of the above embodiments is merely an exemplification to implement the present invention, and the technical scope of the present invention should not be considered as limitative. In other words, the present invention can be variously implemented without departing from the scope or main features thereof.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming system comprising:

a sheet conveying section configured to convey a continuous sheet;

an image forming/fixing section configured to execute an image forming/fixing operation to form and fix a toner image on the continuous sheet to be conveyed by the sheet conveying section;

a skew detection section configured to detect a skew of the continuous sheet to be conveyed by the sheet conveying section;

a skew correction section configured to execute a skew correction operation to correct the skew of the continuous sheet detected by the skew detection section; and a control section configured to perform control to execute the skew correction operation while conveying the continuous sheet without suspending the image forming/fixing operation when the skew of the continuous sheet has been detected by the skew detection section in a first area, and perform control to execute the skew correction operation while conveying the continuous sheet after suspending the image forming/fixing operation when the skew of the continuous sheet has been detected by the skew detection section in a second area.

2. The image forming system according to claim 1, wherein the second area is an area positioned in a vicinity of the image forming/fixing section in a sheet conveyance direction of the continuous sheet.

3. The image forming system according to claim 2, wherein the first area is an area positioned at an upstream side of the image forming/fixing section in the sheet conveyance direction of the continuous sheet and not included in the second area.

4. The image forming system according to claim 2, wherein the first area is an area positioned at a downstream side of the image forming/fixing section in the sheet conveyance direction of the continuous sheet and not included in the second area.

5. The image forming system according to claim 1, wherein the sheet conveying section has a plurality of rotors to convey the continuous sheet, and the skew correction section corrects the skew of the continuous sheet by inclining a rotation axis of the plurality of rotors in a direction orthogonal to a conveyance direction of the continuous sheet.

6. An image forming apparatus comprising:

a sheet conveying section configured to convey a continuous sheet;

an image forming/fixing section configured to execute an image forming/fixing operation to form and fix a toner image on the continuous sheet to be conveyed by the sheet conveying section;

a skew detection section configured to detect a skew of the continuous sheet to be conveyed by the sheet conveying section;

a skew correction section configured to execute a skew correction operation to correct the skew of the continuous sheet detected by the skew detection section; and a control section configured to perform control to execute the skew correction operation without suspending the image forming/fixing operation when the skew has been detected by the skew detection section in a first area, and perform control to execute the skew correction operation after suspending the image forming/fixing operation when the skew has been detected by the skew detection section in a second area.

7. The image forming apparatus according to claim 6, wherein the second area is an area positioned in a vicinity of the image forming/fixing section in a sheet conveyance direction of the continuous sheet.

8. The image forming apparatus according to claim 7, wherein the first area is an area positioned at an upstream side of the image forming/fixing section in the sheet conveyance direction of the continuous sheet and not included in the second area.

9. The image forming apparatus according to claim 7, wherein the first area is an area positioned at a downstream side of the image forming/fixing section in the sheet conveyance direction of the continuous sheet and not included in the second area.

10. The image forming apparatus according to claim 6, wherein the sheet conveying section has a plurality of rotors to convey the continuous sheet, and the skew correction section corrects the skew of the continuous sheet by inclining a rotation axis of the plurality of rotors in a direction orthogonal to a conveyance direction of the continuous sheet.

11. A skew correction method comprising:

detecting a skew of a continuous sheet to be conveyed during an image forming/fixing operation to form and fix a toner image on the continuous sheet; and executing a skew correction operation to correct the detected skew of the continuous sheet during the operation, wherein the skew correction operation is executed while conveying the continuous sheet without suspending the image forming/fixing operation when the skew of the continuous sheet has been detected in a first area, and the skew correction operation is executed while conveying the continuous sheet after suspending the image forming/fixing operation when the skew of the continuous sheet has been detected in a second area.

12. The image forming system according to claim 2, wherein the second area includes an area where the image is applied to the continuous sheet and where the image is fixed.

13. The image forming apparatus according to claim 7, wherein the second area includes an area where the image is applied to the continuous sheet and where the image is fixed.

14. The image forming system according to claim 1, wherein the first area does not include the image forming/fixing section and the second area includes the image forming/fixing section.

15. The image forming apparatus according to claim 6, wherein the first area does not include the image forming/fixing section and the second area includes the image forming/fixing section.

16. The method according to claim 11, wherein the first area does not include the image forming/fixing section and the second area includes the image forming/fixing section.

* * * * *